US011278782B2

(12) United States Patent
McCagg et al.

(10) Patent No.: US 11,278,782 B2
(45) Date of Patent: Mar. 22, 2022

(54) AQUATIC RESISTANCE TRAINING SYSTEM

(71) Applicant: GMX7, LLC, St Petersburg, FL (US)

(72) Inventors: David McCagg, St Petersburg, FL (US); Rob Brady, Sarasota, FL (US); Joel Chartier, Lakewood Ranch, FL (US); Jason Viera, Bradenton, FL (US)

( * ) Notice: Subject to any disclaimer, the term of this patent is extended or adjusted under 35 U.S.C. 154(b) by 4 days.

(21) Appl. No.: 16/888,652

(22) Filed: May 29, 2020

(65) Prior Publication Data

US 2020/0376358 A1 Dec. 3, 2020

Related U.S. Application Data

(60) Provisional application No. 62/855,945, filed on Jun. 1, 2019.

(51) Int. Cl.

| | |
|---|---|
| ***A63B 69/12*** | (2006.01) |
| ***A63B 21/00*** | (2006.01) |
| ***A63B 21/018*** | (2006.01) |

(52) U.S. Cl.

CPC ..... *A63B 69/12* (2013.01); *A63B 21/00065* (2013.01); *A63B 21/018* (2013.01); *A63B 21/4009* (2015.10); *A63B 21/4025* (2015.10); *A63B 21/0004* (2013.01)

(58) Field of Classification Search

CPC ..... A63B 21/018; A63B 21/4009; A63B 21/0004; A63B 21/00058; A63B 21/00065; A63B 21/012; A63B 21/4025; A63B 21/4045; A63B 69/12; A63B 2244/20

See application file for complete search history.

(56) References Cited

U.S. PATENT DOCUMENTS

| | | | | |
|---|---|---|---|---|
| 10,307,654 | B2 * | 6/2019 | Chuang | A63B 21/0442 |
| 10,441,835 | B2 * | 10/2019 | Brooks | A63B 69/12 |
| 10,926,147 | B2 * | 2/2021 | Greenland | A63B 69/12 |
| 2014/0038791 | A1 * | 2/2014 | Bell | A63B 69/12 482/111 |
| 2016/0121194 | A1 * | 5/2016 | Chuang | A63B 21/0442 434/254 |
| 2021/0185300 | A1 * | 6/2021 | Firmin | A63B 69/12 |

* cited by examiner

*Primary Examiner* — Megan Anderson

(74) *Attorney, Agent, or Firm* — Patent CEO LLC; Phillip Vales; Ralph Warmack

(57) ABSTRACT

Technologies are described for aquatic resistance training. An aquatic resistance line may be deployed across the surface of a swimming pool. An aquatic resistance device may be deployed to ride along the resistance line when pulled by a swimmer. The aquatic resistance device comprises offset compression tensioners, each with a wedge-like geometry and a channel for the resistance line. The housing of the aquatic resistance device positions adjacent pairs of the offset compression tensioners into alternating orientation to one another. A mechanical compressor within the aquatic resistance device can force the offset compression tensioners against one another along the axis of the resistance line causing the alternating wedge-like geometries of the offset compression tensioners to force the offset compression tensioners off-axis from one another orthogonal to the aquatic resistance line into a configuration operable to adjustably grip the aquatic resistance line thus providing a resistive training load to the swimmer.

19 Claims, 8 Drawing Sheets

AQUATIC RESISTANCE TRAINING SYSTEM

CROSS-REFERENCE TO RELATED APPLICATION

This application claims the benefit of U.S. provisional patent application No. 62/855,945, filed on Jun. 1, 2019, entitled "Aquatic Resistance Training System," which is expressly incorporated herein by reference in its entirety.

BACKGROUND

Swimmers, while training or undergoing therapy, can often benefit from additional load or drag to their motion through the water. Previous attempts to provide additional swim load are generally difficult or impossible to adjust. They are also variously clumsy, not portable, difficult to install, lacking bidirectional operation, unreliable, and present other barriers to effective use and improved training. Accordingly there is a need in the art for a highly adjustable, bidirectional, portable, and reliable aquatic resistance device to be used in swimmer training, physical therapy, an other mechanical resistance applications.

SUMMARY

Technologies are described for aquatic resistance training. An aquatic resistance line may be deployed across the surface of a swimming pool. An aquatic resistance device may be deployed to ride along the resistance line when pulled by a swimmer. The aquatic resistance device comprises offset compression tensioners, each with a wedge-like geometry and a channel for the resistance line. The housing of the aquatic resistance device can position adjacent pairs of the offset compression tensioners into alternating orientation to one another. A mechanical compressor within the aquatic resistance device can force the offset compression tensioners against one another along the axis of the resistance line causing the alternating wedge-like geometries of the offset compression tensioners to force the offset compression tensioners off-axis from one another orthogonal to the aquatic resistance line into a configuration operable to adjustably grip the aquatic resistance line thus providing a resistive training load to the swimmer.

A mechanical resistance device, comprising: two or more offset compression tensioners, each comprising a wedge-like geometry; a resistance line channel formed through the two or more offset compression tensioners, through a device housing and through a mechanical compressor; wherein a common resistance line passes through the resistance line channel of the device housing, of the two or more offset compression tensioners and of the mechanical compressor; wherein the device housing within which the two or more offset compression tensioners are positioned along the resistance line channel with each adjacent one of the two or more offset compression tensioners having alternating wedge-like geometry opposing one another; a tensioner rail within the device housing configured to mate with the two or more offset compression tensioners so as to direct motion of the two or more offset compression tensioners to linear motion parallel to the resistance line channel while restricting rotational motion of the two or more offset compression tensioners; and wherein the mechanical compressor is operable to force the two or more offset compression tensioners against one another along an axis parallel to the resistance line channel, wherein the alternating wedge-like geometry of the two or more offset compression tensioners forces the two or more offset compression tensioners off-axis from one another orthogonal to the axis parallel to the resistance line channel into a configuration operable to adjustably grip the common resistance line.

In another aspect, wherein the mechanical compressor comprises a rotatable load adjustment cap having a threaded interface with the device housing.

In another aspect, wherein the mechanical compressor comprises an electromechanical actuator operated by a computerized electronic controller.

In another aspect, wherein the resistance line channel within the two or more offset compression tensioners comprise rounded edges along the faces of the two or more offset compression tensioners at transition points between each adjacent one of the two or more offset compression tensioners.

In another aspect, further comprising an electronic controller operable to sample and store a log of training parameters comprising one of resistance load, distance, and time.

In another aspect, wherein the device housing comprises a housing window to allow water to pass through when operated in an aquatic environment.

In another aspect, wherein a load for training a swimmer is provided by the two or more offset compression tensioners adjustably gripping the common resistance line passing through the resistance line channel of the device housing, of the two or more offset compression tensioners and of the mechanical compressor.

In another aspect, wherein the device housing comprises a bidirectional slot for coupling to a belt or harness worn by a swimmer to provide a mechanical resistance load for training the swimmer.

A method for training a swimmer, comprising: providing an aquatic resistance line across a surface of a swimming pool; providing an aquatic resistance device comprising two or more offset compression tensioners, each comprising a wedge-like geometry; a resistance line channel formed through the two or more offset compression tensioners, through a housing and through a mechanical compressor, supporting passage of an aquatic resistance line through the resistance line channel, wherein the housing within which the two or more offset compression tensioners are positioned along the resistance line channel with each adjacent one of the two or more offset compression tensioners having an alternating wedge-like geometry to one another, and the mechanical compressor operable to force the offset compression tensioners against one another along an axis parallel to the resistance line channel, wherein the alternating wedge-like geometry of the two or more offset compression tensioners forces the two or more offset compression tensioners off-axis from one another orthogonal to the aquatic resistance line into a configuration operable to adjustably grip the aquatic resistance line; providing a swimmer belt to be worn by the swimmer; providing a swimmer belt line coupled at a first end to the aquatic resistance device and at a second end to the swimmer belt; and adjusting the mechanical compressor associated with the aquatic resistance device to provide a training load to the swimmer while swimming a path parallel to the aquatic resistance line and pulling the aquatic resistance device along the aquatic resistance line.

In another aspect, wherein the mechanical compressor comprises a rotatable load adjustment cap having a threaded interface with the device housing.

In another aspect, wherein the mechanical compressor comprises an electromechanical actuator operated by a computerized electronic controller.

In another aspect, wherein the resistance line channel within the two or more offset compression tensioners comprises rounded edges along the faces of the two or more offset compression tensioners at transition points between each adjacent one of the two or more offset compression tensioners.

In another aspect, further comprising an electronic controller operable to sample and store a log of training parameters comprising one of resistance load, distance, and time.

In another aspect, wherein the housing comprises a window to allow pool water to pass through.

A resistance device, comprising: a device housing; a resistance line channel through the device housing and passing through: one or more offset compression tensioners located in the device housing; wherein the one or more offset compression tensioners further comprise wedge-like geometry and are positioned in alternating orientation to one another; and a bidirectional slot for attaching a line or harness connecting the resistance device to a user.

In another aspect, wherein the one or more offset compression tensioners adjustably grip a common resistance line passing through the resistance line channel passing through the device housing and through the one or more tensioners thereby providing a resistive load to a user connected to the resistance device.

In another aspect, further comprising a tensioner rail within the device housing configured to mate with one or more compression tensioners found within the device housing so as to direct linear motion of the one or more compression tensioners parallel to the resistance line channel while restricting rotational motion of the one or more compression tensioners.

In another aspect, further comprising one or more load adjustment caps to change the load or drag on a resistance line passing through the resistance line channel.

In another aspect, further comprising: one or more load adjustment caps to adjustably change the load or drag on a resistance line passing through the resistance line channel comprising caps from a group of: mechanical structures and electromechanical components.

It should be appreciated that the above-described subject matter may be implemented as an apparatus, a system, an article of manufacture, or methods/processes associated therewith. These and various other features will be apparent from a reading of the following Detailed Description and a review of the associated drawings. This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DETAILED DESCRIPTION

Figure 1:
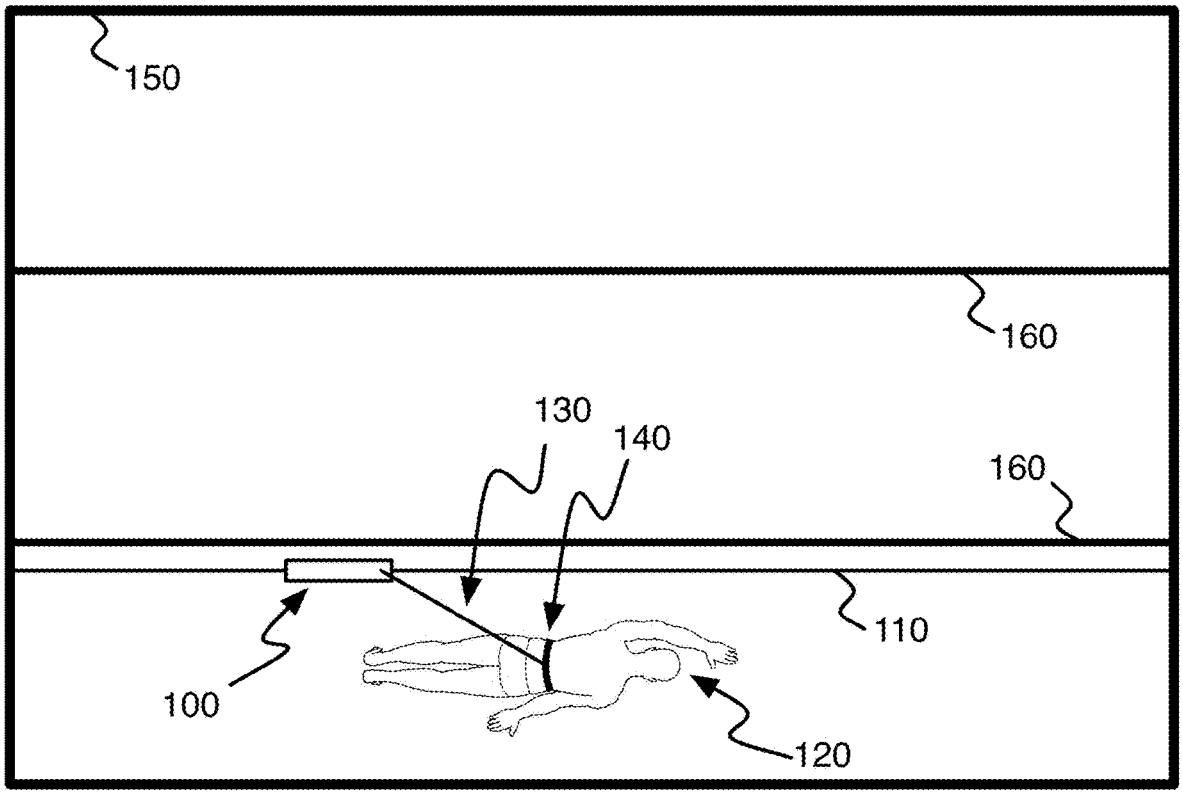
FIG. 1 is a schematic depiction of a swimmer in a swimming pool training with an aquatic resistance device according to one or more embodiments presented herein.

The following description is directed to technologies for aquatic resistance training systems and devices. In the following detailed description, references are made to the accompanying drawings that form a part hereof, and which are shown by way of illustration specific embodiments or examples. Referring now to the drawings, in which like numerals represent like, but not necessarily identical, elements through the several figures, aspects of head-mounted personal privacy solutions will be presented.

Turning first to FIG. 1, a schematic drawing depicts a swimmer 120 in a swimming pool 150 training with an aquatic resistance device 100 according to one or more embodiments presented herein.

A swimming pool 150 can be divided up into swimming lanes using lane dividers 160. Within the swimming pool 150, or within one of the lanes of the swimming pool, an aquatic resistance line 110 can be positioned along a length of the swimming pool 150.

An aquatic resistance device 100 can ride along the aquatic resistance line 110. The aquatic resistance device 100 can be pulled by a swimmer 120. The aquatic resistance line 110 can pass through the aquatic resistance device 100 as the aquatic resistance device 100 rides along the aquatic resistance line 110. The aquatic resistance device 100 can ride along the aquatic resistance line 110 with an adjustable amount of drag or load. This load can be added to the work performed by the swimmer 120 thereby providing a training benefit. This may be considered analogous, for example, to adding a load to motion on dry land by lifting/carrying weights or by adding elastic band or spring-loaded resistance against motion.

The swimmer 120 can be coupled to the aquatic resistance device 100 using a swimmer belt 140 or harness. A swimmer belt line 130 may be connected on a first end to the swimmer belt 140 worn by the swimmer 120. The swimmer belt line 130 may be connected on a second end to the aquatic resistance device 100. As the swimmer 120 moves through the water, the swimmer belt 140 can move along with the swimmer 120 thereby pulling the swimmer belt line 130. In turn, the swimmer belt line 130 can pull the aquatic resistance device 100 to ride along the aquatic resistance line 110.

The aquatic resistance line 110 can be fixed at both ends to walls of the swimming pool 150 or to structures in or around the swimming pool 150. The aquatic resistance line 110 can be any length including a full fifty meter pool length. Accordingly, the swimming load, or training benefit, provided by the aquatic resistance device 100 riding along the aquatic resistance line 110 can be achieved over full competition swimming distances.

The aquatic resistance line 110 can a durable, smooth, and waterproof cord or rope. For example, the aquatic resistance line 110 can be cord or rope comprising polyester, polypropylene, nylon, braided monofilament, and so forth. In certain embodiments, the aquatic resistance line 110 may comprise rope commonly used in sailing applications.

The aquatic resistance or swimming load provided by the aquatic resistance device 100 riding along the aquatic resistance line 110 can provide various training benefits to improve stamina, efficiency, performance, and other key swimmer metrics. The swimming load may be measurable, consistent, and repeatable to further aid training. The swimming load can be smooth and consistent along the full length of operation without any jerky, discontinuous, or non-linear regions in the load curve of the training system.

The aquatic resistance device 100 and associated training system elements presented herein can be extremely portable and adjustable. As a flexible, consistent, and effective training system, there may be a substantial additional benefit of increased use.

It should be appreciated that multiple aquatic resistance lines 110 may be deployed in a swimming pool 150 for training teams or multiple athletes. For example, an aquatic resistance line 110 may be deployed within each swimming lane as defined between lane dividers 160. Aquatic resistance lines 110 may be deployed without lane dividers 160 as the aquatic resistance lines 110 may provide a sense of swimming lanes for the swimmers 120. Also, multiple aquatic resistance lines 110 may be deployed within each swimming lane. For example, one aquatic resistance line 110 may de deployed on each side of a swimming lane.

It should be appreciated that multiple aquatic resistance devices 100 may be run along each aquatic resistance line 110. Such configurations may benefit training teams or multiple athletes.

It should be appreciated that while the present disclosure refers predominantly to athletic training, all applications of the aquatic resistance training system and the aquatic resistance device 100 may be applied to therapeutic applications. Therapeutic application may include physical therapy, occupational therapy, injury/surgical recovery, conditioning, strength training, weight-loss, and so forth.

It should be appreciated that while the present disclosure refers predominantly to use of the aquatic resistance device 100 as a swimming load, the aquatic resistance training system and the aquatic resistance device 100 may be applied to non-swimming scenarios of motion, athletic training, and therapy. For example, the load may be used in rowing, skiing, biking, or running machines. In other examples, the load may be used in strength training systems in place of weights, bands, springs, or other conventional mechanical load systems.

Figure 2:
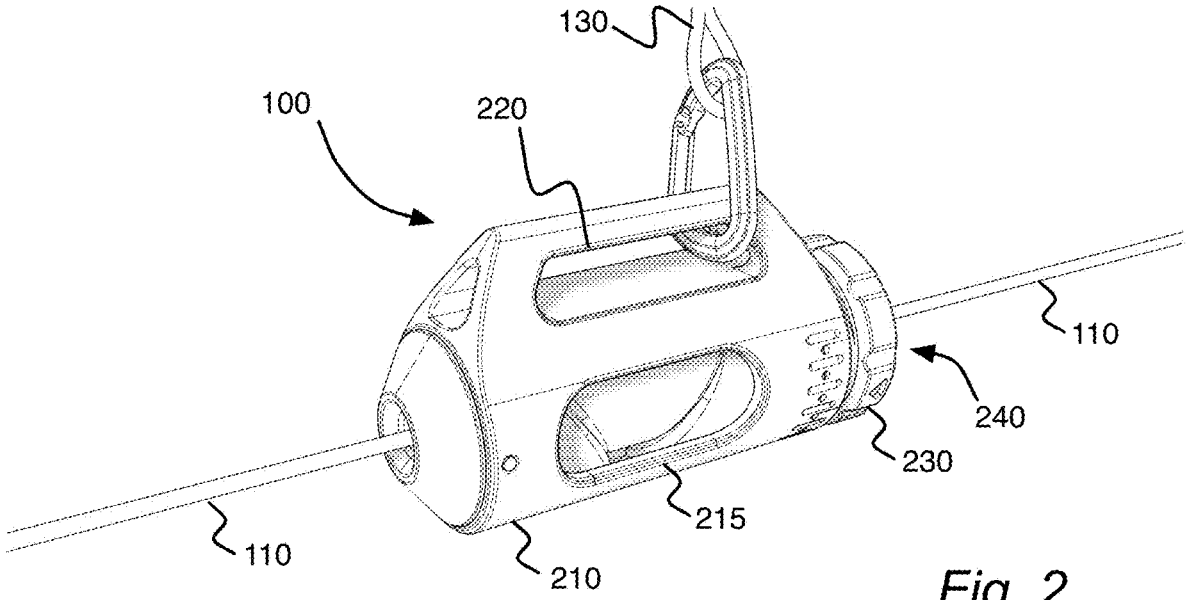
FIGS. 2 and 3 are perspective-view drawings illustrating aquatic resistance devices according to one or more embodiments presented herein.
Figure 3:
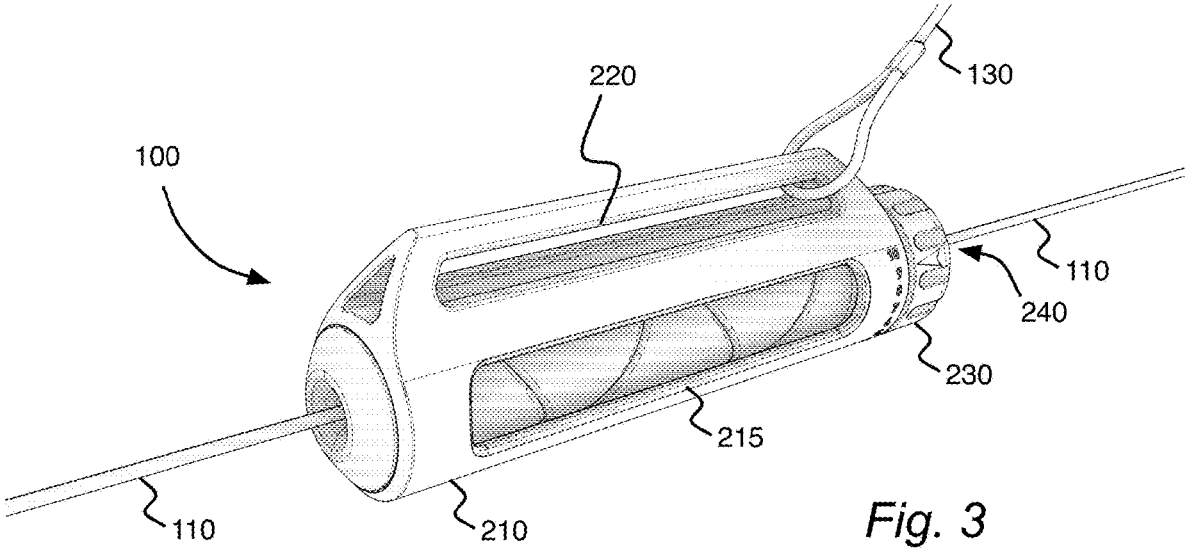

Referring now to FIGS. 2 and 3, perspective-view drawings illustrate aquatic resistance devices 100 according to one or more embodiments presented herein. The aquatic resistance device 100 comprises a device housing 210 with a load adjustment cap 230. The aquatic resistance device 100 may include an electronic controller 240.

The load adjustment cap 230 may be rotated to change the load or drag between the aquatic resistance device 100 and the aquatic resistance line 110. Changing the load or drag may serve to adjust the training benefit imparted on the swimmer 120 by the aquatic resistance training system. It should be appreciated that the aquatic resistance device 100 may comprise multiple load adjustment caps 230. For example, certain embodiments may comprise a load adjustment cap 230 on each end of the aquatic resistance device 100. Certain embodiments of the aquatic resistance device 100 may comprise one load adjustment cap 230 for coarse load adjustment and a second load adjustment cap 230 for fine load adjustment. Certain embodiments of the aquatic resistance device 100 may comprise one load adjustment cap 230 for manual adjustment and a second load adjustment cap 230 for adjustment by the electronic controller 240. Certain embodiments may comprise an integrated adjustment wheel, cam, or similar structure to provide the functionality, or part of the functionality of the load adjustment cap 230 to provide compression as presented herein.

The device housing 210 of the aquatic resistance device 100 may include one or more bidirectional line slots 220 for connecting to the swimmer belt line 130. The bidirectional line slot 220 may be shaped as to allow the aquatic resistance device 100 to be pulled along the aquatic resistance line 110 from either direction. The coupling end of the swimmer belt line 130 may pass along the bidirectional line slot 220 in order to apply a pulling force from either end. This may correspond to the swimmer 120 moving through the water in either direction within the swimming lane. Due to this bidirectional operation, the aquatic resistance system presented herein may be seamlessly used even while the swimmer 120 swims laps in both directions and executes flip-turns at the walls.

The device housing 210 of the aquatic resistance device 100 may include one or more device housing windows 215. The device housing windows 215 can allow water to easily pass into and through the aquatic resistance device 100. Such water flow may provide benefits such as cooling and/or lubrication. The device housing windows 215 may also serve to render the aquatic resistance device 100 easier to clean.

The aquatic resistance device 100 may be fabricated from aluminum, metal alloys, stainless steel, plastic, PVC, the polymers, or any combination thereof.

A computerized electronic controller 240 may be incorporated into the aquatic resistance device 100. The electronic controller 240 may be operable to track training information as well as to control the load adjustment cap 230 of the aquatic resistance device 100. The electronic controller 240 can select the adjustable training load of the aquatic resistance device 100 using one or more motors, pistons, solenoids, or other electromechanical actuators. The actuators can position the load adjustment cap 230 or otherwise provide compression within the aquatic resistance device 100 to adjust the resultant training load. According to various embodiments, the computerized electronic controller 240 may be incorporated into the aquatic resistance device 100, external to the aquatic resistance device 100, coupled to the aquatic resistance line 110, otherwise located in relation to the aquatic resistance device 100, or distributed in its functionality to multiple such positions.

The electronic controller 240 can support sensors a digital recording feature operable to sample and store a log of the training load, operating distances, times, speeds, acceleration, rest/recovery periods, and other information that may be useful to track or analyze training. Data stored in the log may be time stamped. The electronic controller 240 can interface with fitness applications on mobile devices, fitness watches, fitness bands, and other training systems and software applications to transfer the logged data or related analysis results. The interface may also serve to set information within the electronic controller 240 related to training, the training load, desired load curves over time, or data logging functions. The interface may be wired or wireless and may utilize communication technology such as Bluetooth, Wi-Fi, or other personal area network (PAN) solutions.

Figure 4:
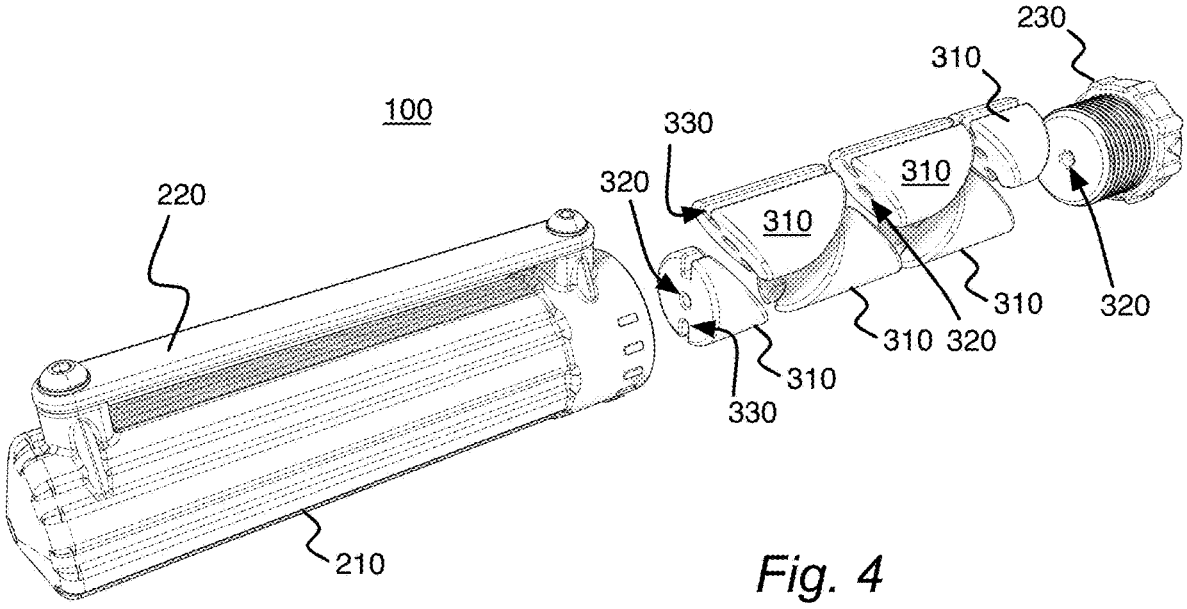
FIGS. 4 and 5 are exploded perspective-view drawings illustrating aquatic resistance devices according to one or more embodiments presented herein.
Figure 5:
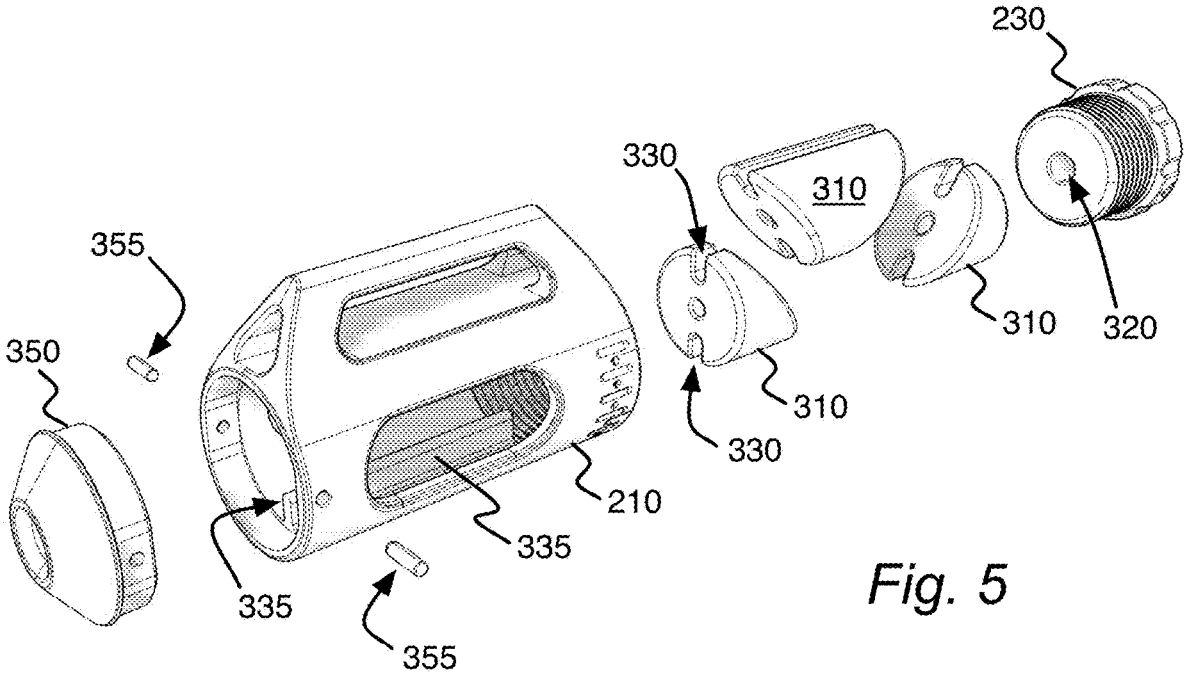

Referring now to FIGS. 4 and 5, exploded perspective-view drawings illustrate aquatic resistance devices 100 according to one or more embodiments presented herein.

One or more offset compression tensioners 310 may be positioned within the device housing 210 of the aquatic resistance device 100. A resistance line channel 320 through the device housing 210, the offset compression tensioners 310, and the load adjustment cap 230 can allow the aquatic resistance line 110 to pass through the aquatic resistance device 100.

Adjusting a position of the load adjustment cap 230 can compress (or decompress) the offset compression tensioners 310 along the axis of the resistance line channel 320. Geometry of the compression tensioners 310 can include one or more angled or wedge-like facets. The wedge-like facets can operate to force the offset compression tensioners 310 away from one another (substantially orthogonal to the axis of the resistance line channel 320) when they are compressed together within the device housing 210 by the load adjustment cap 230.

Forcing the offset compression tensioners 310 orthogonal to the axis of the resistance line channel 320 can position the offset compression tensioners 310 slightly off-axis from the resistance line channel 320. Alternating orientation of the wedge-like facets of the offset compression tensioners 310 can push the offset compression tensioners 310 into an alternating offset geometry as the offset compression tensioners 310 are compressed together within the device housing 210 by the load adjustment cap 230. This alternating offset positioning of the offset compression tensioners 310 can provide opposing tension on the aquatic resistance line 110 passing through the resistance line channel 320.

Positioning the load adjustment cap 230 can alter the amount of offset between the offset compression tensioners 310. The amount of offset between the offset compression tensioners 310 can alter the drag or load between the aquatic resistance device 100 and the aquatic resistance line 110, thereby adjusting the training load of the aquatic resistance device 100. The positioning of the load adjustment cap 230 can be calibrated to various values of training load. The load adjustment cap 230 can be marked with increments, numbers, or other indicators relating to the calibrated or expected training load of the aquatic resistance device 100.

The offset compression tensioners 310 can incorporate a tensioner track 330 to support the offset compression tensioners 310 within the device housing 210 as the load adjustment cap 230 is adjusted. The device housing 210 can incorporate a tensioner rail 335 to mate with the tensioner track 330. The tensioner rail 335 can comprise a geometry of a rail along the interior of the device housing 210. The geometry of the tensioner rail 335 may alternatively comprise tabs, ribs, or other structure operable to mate with the tensioner track 330 within the offset compression tensioners 310. The tensioner tracks 330 can operate to restrict motion of the offset compression tensioners 310 within the device housing 210. Motion of the offset compression tensioners 310 within the device housing 210 may be restricted to occur predominantly along the axis of the resistance line channel 320. Motion of the offset compression tensioners 310 within the device housing 210 may be restricted to not occur rotationally around the axis of the resistance line channel 320.

Smoothed, rounded, or chamfered edges at transition points along the resistance line channel 320 can support movement of the aquatic resistance device 100 along the aquatic resistance line 110 while the aquatic resistance line 110 passes through the resistance line channel 320. The edges may occur at openings within the faces of the load adjustment cap 230, the offset compression tensioner 310, and the device housing 210. Wet pool operating environment of the aquatic resistance device 100 can support movement of the aquatic resistance device 100 along the aquatic resistance line 110.

Angled or wedge-like facets of the compression tensioners 310 can include various different orientations or angles. As illustrated, facets of approximately forty-five degrees can generate the alternating offset geometry as the offset compression tensioners 310 are compressed together within the device housing 210.

According to various embodiments, the aquatic resistance device 100 may include a bidirectional line slot 220 integrated into structure of the device housing 210. Alternatively, the aquatic resistance device 100 may include a bidirectional line slot 220 that is externally affixed to structures of the device housing 210.

According to various embodiments, the device housing 210 associated with the aquatic resistance device 100 may incorporate a closed end opposite from the load adjustment cap 230 as illustrated in FIG. 4. According to various other embodiments, the device housing 210 associated with the aquatic resistance device 100 may incorporate a removable end cap 350 opposite from the load adjustment cap 230 as illustrated in FIG. 5. The removable end cap 350 may be affixed into the device housing 210 using adhesive, threading, or one or more fasteners 355. The fasteners 355 may be affixed with adhesive, welding, screw threads, rivets, pressure fitting, other mechanisms, or any combination thereof.

It should be appreciated that while the present disclosure predominantly discusses the aquatic resistance device 100 moving along a fixed aquatic resistance line 110, the aquatic resistance device 100 may be fixed while the aquatic resistance line is moved through the aquatic resistance device 100.

Figure 6:
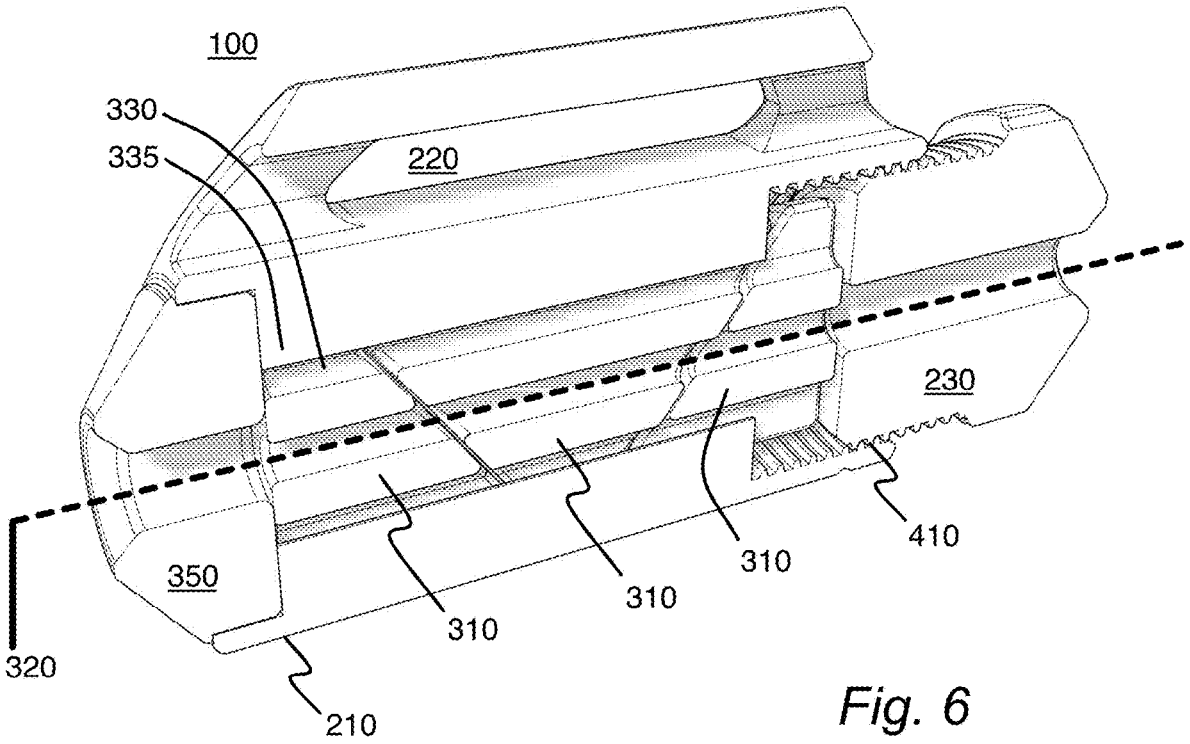
FIG. 6 is a cross-sectional drawing illustrating an aquatic resistance device in an uncompressed state according to one or more embodiments presented herein.

Referring now to FIG. 6, a cross-sectional drawing illustrates an aquatic resistance device 100 in an uncompressed state according to one or more embodiments presented herein. A threaded interface 410 between the load adjustment cap 230 and the device housing 210 can support compression of the offset compression tensioners 310 as the load adjustment cap 230 is rotated. The offset compression tensioners 310 can be compressed together within the device housing 210 as the load adjustment cap 230 is rotated to tighten within the threaded interface 410. However, in the uncompressed state, the load adjustment cap 230 may not be tightened within the threaded interface 410 and thus may not compress the offset compression tensioners 310 to grip against the aquatic resistance line 110.

Offset positioning (substantially orthogonal to the resistance line channel 320) among the offset compression tensioners 310 can alter the edges and geometry of the resistance line channel 320. In the illustrated uncompressed state, the offset compression tensioners 310 may not be compressed together along the axis of the resistance line channel 320 and thus may not be forced off-axis from the resistance line channel 320. Accordingly, the resistance line channel 320 may remain substantially co-linear comprising a centerline that is substantially coaxial with the interior surfaces of the resistance line channel 320. While uncompressed, the resistance line channel 320 is not reduced against the offset compression tensioners 310 and there may be little or no increase in drag or load between the aquatic resistance device 100 and the aquatic resistance line 110. Accordingly, the training load of the aquatic resistance device 100 may be in a minimal or reduced state.

Tensioner tracks 330 within the offset compression tensioners 310 can mate with, and ride along, one or more tensioner rails 335 within the device housing 210 associated with the aquatic resistance device 100. The tensioner tracks 330 and tensioner rails 335 can combine to restrict motion of the offset compression tensioners 310 within the device housing 210. Motion of the offset compression tensioners 310 may be restricted to occur linearly along the axis of the resistance line channel 320 while not rotating around the axis of the resistance line channel 320.

Figure 7:
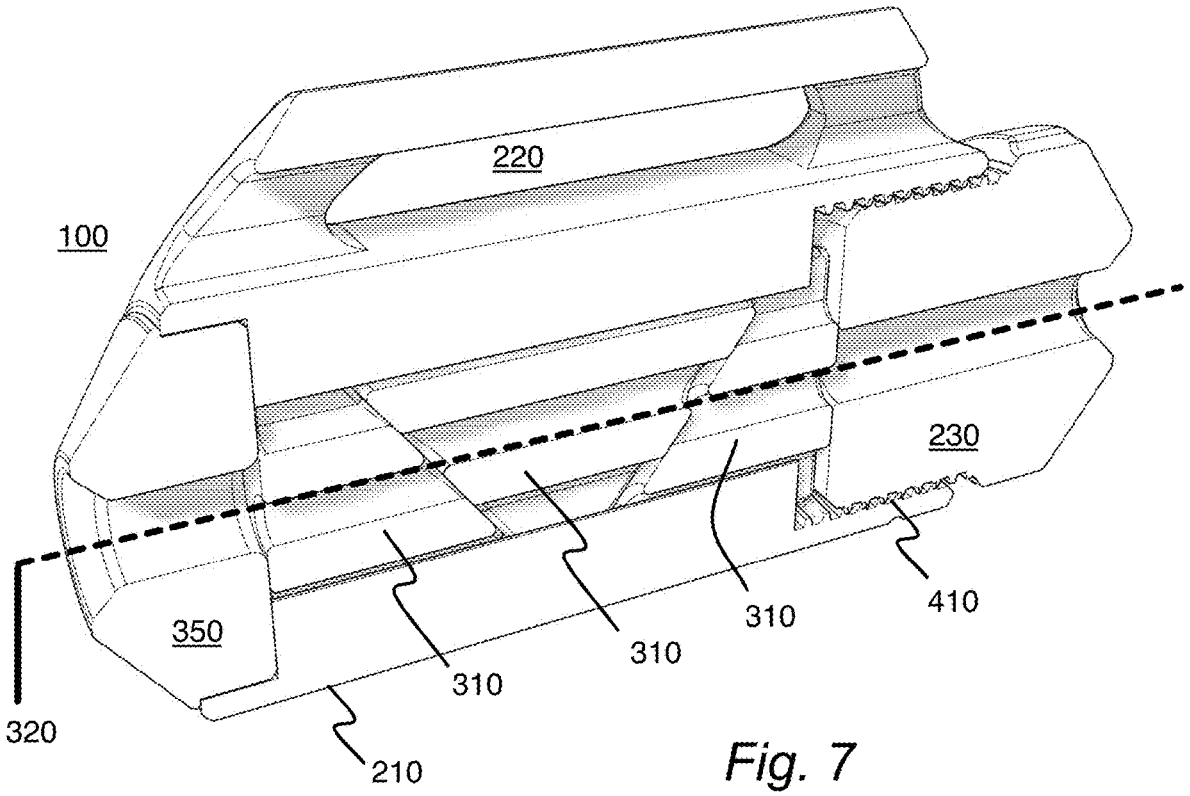
FIG. 7 is a cross-sectional drawing illustrating an aquatic resistance device in a compressed state according to one or more embodiments presented herein.

Referring now to FIG. 7, a cross-sectional drawing illustrates an aquatic resistance device 100 in a compressed state according to one or more embodiments presented herein. A threaded interface 410 between the load adjustment cap 230 and the device housing 210 can support compression of the offset compression tensioners 310 as the load adjustment cap 230 is rotated or tightened. The offset compression tensioners 310 can be compressed together within the device housing 210 as the load adjustment cap 230 is rotated to tighten within the threaded interface 410.

Offset positioning (orthogonal to the resistance line channel 320) among the offset compression tensioners 310 can alter the edges and geometry of the resistance line channel 320. In the compressed state, the resistance line channel 320 may be effectively reduced as the offset compression tensioners 310 are compressed together along the axis of the resistance line channel 320 and thus forced slightly off-axis from the resistance line channel 320. Effective reduction of the resistance line channel 320 can increase the drag or load between the aquatic resistance device 100 and the aquatic resistance line 110, thereby adjusting the training load of the aquatic resistance device 100.

Figure 8:
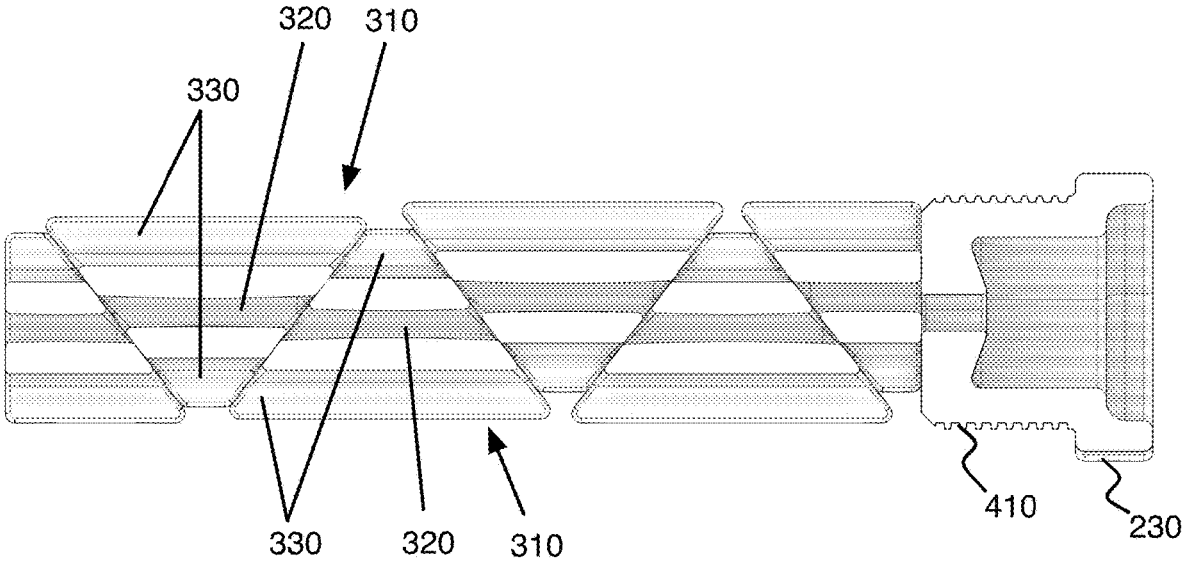
FIG. 8 is a cross-sectional drawing illustrating offset compression tensioners for an aquatic resistance device according to one or more embodiments presented herein.

Referring now to FIG. 8, a cross-sectional drawing illustrates offset compression tensioners 310 for an aquatic resistance device 100 according to one or more embodiments presented herein.

The threaded interface 410 between the load adjustment cap 230 and the device housing 210 can support compression of the offset compression tensioners 310 as the load adjustment cap 230 is rotated. As the offset compression tensioners 310 are compressed together along the axis of the resistance line channel 320 and thus forced slightly off-axis from the resistance line channel 320, the offset compression tensioners 310 can provide opposing tension on the aquatic resistance line 110 passing through the resistance line channel 320. The offset compression tensioners 310 can incorporate a tensioner track 330 to support the offset compression tensioners 310 within the device housing 210 as the load adjustment cap 230 is adjusted.

According to various embodiments, the offset compression tensioners 310 can be compressed within the device housing 210 associated with the aquatic resistance device 100 by a mechanical compressor. Examples of the mechanical compressor include, among others, rotation of the load adjustment cap 230, a compression cam, an electromechanical actuator, a spring, a magnetic mechanism, a motor, a wedge, a lever, or any other such compression device or structure.

Based on the foregoing, it should be appreciated that technologies for aquatic resistance training systems and devices are presented herein. Although the subject matter presented herein has been described in specific language related to structural features or methodological acts, it is to be understood that the invention defined in the appended claims is not necessarily limited to the specific features or acts described herein. Rather, the specific features and acts are disclosed as example forms of implementation.

The subject matter described above is provided by way of illustration only and should not be construed as limiting. Various modifications and changes may be made to the subject matter described herein without following the example embodiments and applications illustrated and described, and without departing from the true spirit and scope of the present invention.

What is claimed is:

1. A mechanical resistance device, comprising:

two or more offset compression tensioners, each comprising a wedge-like geometry;

a resistance line channel formed through the two or more offset compression tensioners, through a device housing and through a mechanical compressor;

wherein a common resistance line passes through the resistance line channel of the device housing, of the two or more offset compression tensioners and of the mechanical compressor;

wherein the device housing within which the two or more offset compression tensioners are positioned along the resistance line channel with each adjacent one of the two or more offset compression tensioners having alternating wedge-like geometry opposing one another;

a tensioner rail within the device housing configured to mate with the two or more offset compression tensioners so as to direct motion of the two or more offset compression tensioners to linear motion parallel to the resistance line channel while restricting rotational motion of the two or more offset compression tensioners; and wherein the mechanical compressor is operable to force the two or more offset compression tensioners against one another along an axis parallel to the resistance line channel, wherein the alternating wedge-like geometry of the two or more offset compression tensioners forces the two or more offset compression tensioners off-axis from one another orthogonal to the axis parallel to the resistance line channel into a configuration operable to adjustably grip the common resistance line.

2. The mechanical resistance device of claim 1, wherein the mechanical compressor comprises a rotatable load adjustment cap having a threaded interface with the device housing.

3. The mechanical resistance device of claim 1, wherein the mechanical compressor comprises an electromechanical actuator operated by a computerized electronic controller.

4. The mechanical resistance device of claim 1, wherein the resistance line channel within the two or more offset compression tensioners comprise rounded edges along the faces of the two or more offset compression tensioners at transition points between each adjacent one of the two or more offset compression tensioners.

5. The mechanical resistance device of claim 1, further comprising an electronic controller operable to sample and store a log of training parameters comprising one of resistance load, distance, and time.

6. The mechanical resistance device of claim 1, wherein the device housing comprises a housing window to allow water to pass through when operated in an aquatic environment.

7. The mechanical resistance device of claim 1, wherein a load for training a swimmer is provided by the two or more offset compression tensioners adjustably gripping the common resistance line passing through the resistance line channel of the device housing, of the two or more offset compression tensioners and of the mechanical compressor.

8. The mechanical resistance device of claim 1, wherein the device housing comprises a bidirectional slot for coupling to a belt or harness worn by a swimmer to provide a mechanical resistance load for training the swimmer.

9. A method for training a swimmer, comprising:

providing an aquatic resistance line across a surface of a swimming pool;

providing an aquatic resistance device comprising two or more offset compression tensioners, each comprising a wedge-like geometry; a resistance line channel formed through the two or more offset compression tensioners, through a housing and through a mechanical compressor, supporting passage of an aquatic resistance line through the resistance line channel, wherein the housing within which the two or more offset compression tensioners are positioned along the resistance line channel with each adjacent one of the two or more offset compression tensioners having an alternating wedge-like geometry to one another, and the mechanical compressor operable to force the offset compression tensioners against one another along an axis parallel to the resistance line channel, wherein the alternating wedge-like geometry of the two or more offset compression tensioners forces the two or more offset compression tensioners off-axis from one another orthogonal to the aquatic resistance line into a configuration operable to adjustably grip the aquatic resistance line;

providing a swimmer belt to be worn by the swimmer;

providing a swimmer belt line coupled at a first end to the aquatic resistance device and at a second end to the swimmer belt; and adjusting the mechanical compressor associated with the aquatic resistance device to provide a training load to the swimmer while swimming a path parallel to the aquatic resistance line and pulling the aquatic resistance device along the aquatic resistance line.

10. The method of claim 9, wherein the mechanical compressor comprises a rotatable load adjustment cap having a threaded interface with the device housing.

11. The method of claim 9, wherein the mechanical compressor comprises an electromechanical actuator operated by a computerized electronic controller.

12. The method of claim 9, wherein the resistance line channel within the two or more offset compression tensioners comprises rounded edges along the faces of the two or more offset compression tensioners at transition points between each adjacent one of the two or more offset compression tensioners.

13. The method of claim 9, further comprising an electronic controller operable to sample and store a log of training parameters comprising one of resistance load, distance, and time.

14. The method of claim 9, wherein the housing comprises a window to allow pool water to pass through.

15. A resistance device, comprising:

a device housing;

a resistance line channel through the device housing and passing through:

one or more offset compression tensioners located in the device housing, wherein the one or more offset compression tensioners further comprise wedge-like geometry and are positioned in alternating orientation to one another; and a bidirectional slot for attaching a line or harness connecting the resistance device to a user.

16. The resistance device of claim 15, wherein the one or more offset compression tensioners adjustably grip a common resistance line passing through the resistance line channel passing through the device housing and through the one or more tensioners thereby providing a resistive load to the user connected to the resistance device.

17. The resistance device of claim 15, further comprising a tensioner rail within the device housing configured to mate with one or more compression tensioners found within the device housing so as to direct linear motion of the one or more compression tensioners parallel to the resistance line channel while restricting rotational motion of the one or more compression tensioners.

18. The resistance device of claim 15, further comprising one or more load adjustment caps to change the load or drag on a resistance line passing through the resistance line channel.

19. The resistance device of claim 15, further comprising: one or more load adjustment caps to adjustably change the load or drag on a resistance line passing through the resistance line channel comprising caps from a group of: mechanical structures and electromechanical components.

* * * * *